US005203624A

United States Patent [19]

Schier et al.

[11] Patent Number: 5,203,624

[45] Date of Patent: Apr. 20, 1993

[54] HAZARD WARNING DEVICE

[75] Inventors: J. Alan Schier, Tujunga, Calif.; Karl G. Thompson, Willowdale, Canada; Gregg F. Thompson, Dallas, Tex.

[73] Assignee: G.A. Thompson Company, Inc., Dallas, Tex.

[21] Appl. No.: 880,055

[22] Filed: May 7, 1992

[51] Int. Cl.[5] ..... F21L 7/00

[52] U.S. Cl. ..... 362/158; 362/186; 362/183; 362/206

[58] Field of Search ..... 362/158, 183, 186, 206

[56] References Cited

U.S. PATENT DOCUMENTS

| | | | |
|---|---|---|---|
| 2,176,301 | 10/1939 | Haas | 240/10.66 |
| 2,695,403 | 11/1954 | Stoker et al. | 340/321 |
| 2,830,280 | 4/1958 | Webber | 339/191 |
| 3,261,973 | 7/1966 | Kott | 362/183 |
| 3,281,637 | 10/1966 | Hultquist | 320/2 |
| 4,345,305 | 8/1982 | Kolm et al. | 362/186 |
| 4,609,976 | 9/1986 | Geissler | 362/202 |
| 4,782,432 | 11/1988 | Coffman | 362/184 |
| 5,006,969 | 4/1991 | Lai | 362/206 |
| 5,122,781 | 6/1992 | Saubolle | 340/473 |
| 5,122,938 | 6/1992 | Pastusek | 362/206 |

OTHER PUBLICATIONS

Page 49 of Gall's Inc. Catalog No. 92D (1992).

Exhibit "A"-McDermott, Julian A. Corp. brochure for hermetically sealed buoy lights having flashers (believed to be published or used prior to Apr. 1991), 1 page 6842.

Exhibit "B"-Pelican Products brochure for flashlights (believed to be published or used prior to Apr. 1991), 10 pages.

Exhibit "C"-Mity Lite TM Mini System brochure for flashlights (believed to be published or used prior to Apr. 1991), 2 pages.

Exhibit "D"-Koehler Manufacturing Company brochure for lamps and lanterns (believed to be published or used prior to Apr. 1991), 1 page 6002.

Exhibit "E"-American Cyanamid Company brochure for Cyalume Lightsticks (believed to published or used prior to Apr. 1991), 1 page 691.

Exhibit "F"-Southern Vehicle Products Inc. brochure for Impulse 2000 Lightbar Series halogen flashers (believed to be published or used prior to Apr. 1991), 1 page 10348.

Exhibit "G"-Industrial Safety & Security Co. brochure for safety lights (believed to be published or used prior to Apr. 1991), 1 page 5306.

Exhibit "H"-Industrial Safety & Security Co. brochure for big beam emergency lights (believed to be published or used prior to Apr. 1991), 1 page 5307.

Exhibit "I"-McDermott Julian A. Corp. brochure for barricade type lights (believed to be published or used prior to Apr. 1991), 1 page 6837.

Exhibit "J"-McDermott, Julian A. Corp. brochure for barricade lights (believed to be published or used prior to Apr. 1991), 1 page 6835.

*Primary Examiner*—Carroll B. Dority

*Attorney, Agent, or Firm*—Laney, Dougherty, Hessin & Beavers

[57] ABSTRACT

A portable electric warning light comprises an elongated electrically conducting housing to which an end cap is connected at one end to provide an on/off switch function and to which a gas discharge flash tube is connected at the other end for emitting, through both end and side walls of a cover connected to the housing, bright flashes of light in response to the operation of batteries and an electronic circuit contained within the housing. The batteries are rechargeable, which can be accomplished in a particular implementation wherein external terminals provide access to the batteries without disassembling the light. The connection of one end of the batteries to the electronic circuit is made through the end cap assembly and the housing, and in one embodiment the connection of the other end of the batteries to the electronic circuit is made through the metallic housing of a flash capacitor forming part of the circuit. In another embodiment, this latter connection is made through a conductive path around the outside of an insulated housing of the flash capacitor. The end cap and a bumper member can be used for supporting the housing off a supporting surface.

21 Claims, 2 Drawing Sheets

HAZARD WARNING DEVICE

BACKGROUND OF THE INVENTION

This invention relates generally to hazard warning devices and more particularly, but not by way of limitation, to a portable electric warning light used to alert motorists to road hazards.

Hazard warning devices have various uses. For example, when a motorist has a flat tire and pulls to the side of the road, such devices can be placed along the roadway to alert oncoming traffic. Examples of devices that can be so used include chemical flares, electric lights and reflective markers.

Chemical flares typically give off a low intensity light. Flares typically have a limited operating life, such as approximately twenty minutes, for example. Flares are not reusable, which is at least one factor in making them relatively expensive. The heat generated by a flare makes it unsafe in flammable environments, and the combustion that occurs can pollute the air. The spent flare is solid waste that can pose a disposal problem. A flare can be unreliable in rain or snow because the moisture can adversely affect the chemical reaction by which a flare works.

As to electric warning lights, some we are aware of give off low intensity illumination, thereby making them relatively hard to see. Others may give off high intensity illumination, but these typically can operate only for a relatively short time when battery powered. These also tend to be bulky so that it is inconvenient to transport them. These electrical devices are also typically breakable so that they cannot survive moderate abuse, and they are also relatively expensive.

Reflective warning devices may be relatively inexpensive in that they can be reused indefinitely if they are sturdy enough; however, this type of warning device requires an external source of illumination to be readily seen. Reflective warning devices typically have a restricted viewing angle so that they must be carefully oriented to pick up the external illumination. Such reflective warning devices typically perform poorly under conditions of marginal visibility, such as fog.

In view of the foregoing shortcomings of these various types of warning devices, there is the need for an improved warning device that is highly functional, yet relatively simple in design and relatively inexpensive for the use it provides.

SUMMARY OF THE INVENTION

The present invention overcomes the above-noted and other shortcomings of the prior art by providing a novel and improved hazard warning device embodied as a portable electric warning light.

The present invention provides a compact, easily handled and transported electric warning light that is highly visible under widely varying conditions and that operates for an extended time compared to flares. The illumination provided by the present invention is also visible over a wide field of view. Its operation is substantially unaffected by poor weather, and it is durable both as to its body and its illumination element. The present invention presents little or no environmental hazards, and it is relatively economical.

The portable electric warning light of the present invention comprises an elongated metallic, electrically conductive housing having two ends and an internal chamber. The warning light further comprises a plurality of batteries disposed linearly in electrical series within the internal chamber so that a first terminal of the batteries is at one end of the housing and a second terminal of the batteries is intermediate the two ends of the housing. The warning light still further comprises closure means for fluid tightly closing the one end of the housing and for activating the warning light, wherein the closure means includes: an end cap connected to the housing at the one end thereof so that the end cap is movable between first and second positions relative to the housing; seal means for providing a fluid tight seal between the end cap and the housing when the end cap is connected to the housing at the second position; and connecting means for electrically connecting the first terminal of the batteries to the housing when the end cap is connected to the housing at the second position. The warning light also comprises: a gas discharge flash tube connected to the other end of the housing, and a cover overlying the gas discharge flash tube and connected to the housing at the other end thereof, the cover having a side wall and an end wall both of material which permits passage of visible light therethrough. The warning light further comprises electronic means, connected to the gas discharge flash tube and the housing, for causing the gas discharge flash tube to emit flashes of light visible through the cover when the end cap is connected to the housing at the second position so that the connecting means connects the first terminal of the batteries to the housing, wherein the electronic means includes a flash capacitor disposed in the housing between the batteries and the gas discharge flash tube. In particular implementations, connection of the electronic means to one terminal of the batteries is through either a metallic housing of the flash capacitor or a conductive member adjacent an insulated housing of the flash capacitor.

In a preferred embodiment, the end cap has a lateral dimension greater than a maximum lateral dimension of the housing and the warning light further comprises a bumper member at the other end of the housing of greater lateral dimension than the maximum lateral dimension of the housing so that the warning light is supported on the end cap and the bumper when the warning light is laid on a support surface, wherein the housing is thereby spaced from the support surface.

In a particular implementation, the warning light further comprises: first terminal means for providing on the outside of the end cap a terminal connected through the end cap to the first terminal of the batteries; and second terminal means for providing on the outside of the bumper member a terminal connected through the bumper member to the second terminal of the batteries.

Therefore, from the foregoing, it is a general object of the present invention to provide a novel and improved hazard warning device. Other and further objects, features and advantages of the present invention will be readily apparent to those skilled in the art when the following description of the preferred embodiments is read in conjunction with the accompanying drawings.

BRIEF DESCRIPTION OF THE DRAWINGS

FIG. 3 is a schematic circuit diagram of another preferred embodiment oscillator circuit of the warning light of the present invention.

DETAILED DESCRIPTION OF PREFERRED EMBODIMENTS

Figure 1:
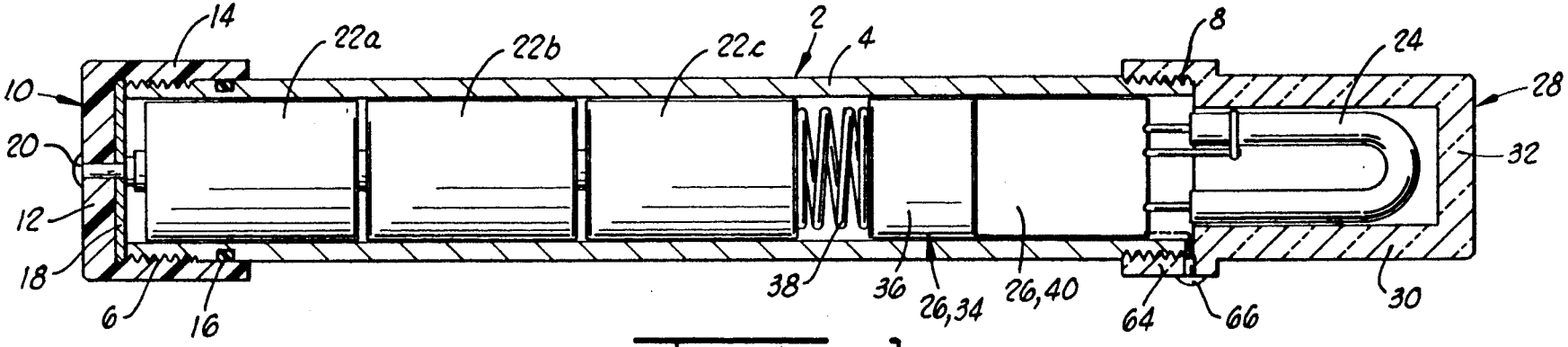
FIG. 1 is a sectional view of a preferred embodiment portable electric warning light of the present invention.

The preferred embodiment portable electric warning light is shown in FIG. 1. It includes a housing 2 that provides a suitably sturdy and functional enclosure for flash electronics. It also preferably serves as a highly visible element in and of itself, such as by being distinctively painted, thereby increasing the overall effectiveness of the device as a hazard indicator.

The housing 2 preferably includes a metallic, electrically conductive tube or sleeve 4, such as specifically an aluminum tube anodized with a suitably bright color (e.g., orange or red) to enhance its visibility. The sleeve 4 has a generally cylindrical shape of constant diameter along its length. The sleeve 4 has two ends 6, 8, both of which are externally threaded.

Connected to the end 6 is a nonconducting plastic end cap 10. The integral end cap 10 has a circular end wall 12 and a cylindrical side wall 14. The side wall 14 is threaded on its inner surface so that the end cap 10 can be screwed on the thread at the end 6 of the sleeve 4. The end cap 10 can be screwed on the sleeve 4 to an activation position relative to the sleeve 4, and it can be unscrewed therefrom. When screwed on to the activation position as shown in FIG. 1, the end cap 10 and the sleeve 4 are fluid tightly sealed by an intervening seal ring 16 (e.g., an O-ring).

The end cap 10 and seal ring 16 form part of a closure means for fluid tightly closing the end 6 of the sleeve 4 and for activating the warning light. This activation function is provided via a metallic, electrically conductive disk 18 that is inside the end cap 10 adjacent the inner surface of the end wall 12. This disk 18 provides one switch contact, and another switch contact is provided by the edge of the end 6 of the sleeve 4. These two contacts of this switch mechanism for turning the warning light on and off engage each other, thereby completing a circuit subsequently described, when the end cap 10 is fully engaged on the sleeve 4 to the aforementioned activation position shown in FIG. 1.

The disk 18 is held on the end cap 10 by a metallic, electrically conductive rivet 20 that passes through the end wall 12 of the end cap 10 so that one end of the rivet 20 is on the outside of the end cap 10 and the other end of the rivet 20 abuts and holds the disk 18. The external end of the rivet 20 can function as a terminal that provides electrical access into the internal circuit without disassembling the warning light. The internal end of the rivet 20 is in electrical contact with, such as by abutting or engaging, the positive terminal of batteries 22 when the end cap 10 is screwed on the sleeve 4 to the activation position.

With the end cap 10 fully engaged on the sleeve 4 to the activation position and the disk 18 in contact with the sleeve 4 and the rivet 20 in contact with the batteries 22, the electrical circuit is closed so that the device will operate. As soon as the end cap 10 is unscrewed sufficiently to another position, at least contact between the disk 18 and the sleeve 4 is broken, removing power from the circuit. The cap 10 nevertheless remains sealed to the sleeve 4 by the seal ring 16 during this relatively slight disengagement. The cap 10 may also be unscrewed entirely from the sleeve 4 in order to remove the batteries 22, which provide the energy for the warning light.

The batteries 22 are preferably rechargeable so that they can be reused. Recharging can occur through the external terminal provided by the rivet 20 and another external terminal subsequently described. In the preferred embodiments, three batteries 22*a*, 22*b*, 22*c* are disposed linearly in electrical series within the internal chamber of the sleeve 4. Whereas the positive terminal of these linearly disposed batteries 22 is disposed to abut or engage the rivet 20, the negative terminal of the batteries 22 (for the FIG. 1 orientation) is intermediate the two ends 6, 8 of the sleeve 4.

A specific type of battery contemplated to be used in the preferred embodiment is a conventional nickel-cadmium (NiCad) "subC" cell having a nominal rating of 1.2 volts. Using three such cells with a capacity of about 1.8 amp-hours each (nominal total energy=3 batteries×1.2 volts/battery×1.8 amp-hours/battery=6.48 watt-hours=23.3 kilojoules), nominal performance parameters are contemplated to be as follows when the cells are charged or recharged at about 25° C.:

flash power per flash discharge: 2.2 joules
initial flash interval: 1.3 seconds
flash interval after five minutes: 1.4 seconds
flash interval after 30 minutes: 1.5 seconds
flash interval after 60 minutes: 1.6 seconds
flash interval after 70 minutes: 1.9 seconds
maximum operating time: 80 minutes Upon appropriately screwing the end cap 10 onto the sleeve 4, the batteries 22 provide their energy to operate a gas discharge flash tube 24 and an oscillator circuit 26 which complete the overall circuit that also includes the sleeve 4, the end 6 closure structure and the batteries 22.

The flash tube 24 is preferably a xenon tube that is connected at the end 8 of the sleeve 4. The flash tube 24 is enclosed within lens or cover 28 that is threadedly connected to the threaded end 8. The cover 28 has a side wall 30 and an end wall 32, both of which are made of a material that permits passage of visible light and both of which overlie the flash tube 24 so that light can be transmitted out of the warning device both through the end thereof and around the complete circumference thereof. In the preferred embodiments, the cover 28 is made of transparent polycarbonate plastic so that it is very durable and resistant to chipping and fracturing.

The flash tube 24 is electrically connected to the oscillator circuit 26 so that when the overall circuit is closed via screwing on the end cap 10, oscillating signals are generated by the circuit 26 to cause the flash tube 24 to emit flashes of light visible through the cover 28. The main portion of the oscillator circuit 26 is disposed adjacent the terminal end of the flash tube 24 as shown in FIG. 1. It is specifically shown disposed between the flash tube 24 and a flash capacitor 34, which is also part of the oscillator circuit 26.

The flash capacitor 34 of the FIG. 1 embodiment has a metallic, electrically conductive outer housing 36 that is in electrical contact with the other terminal of the batteries 22 (i.e., the negative terminal of battery 22*c* as depicted in FIG. 1) by abutting a metallic, electrically conductive spring 38 that abuts at its other end such other terminal of the batteries 22. The flash capacitor housing 36 is also in electrical contact with the ground plane of a printed circuit board 40 containing the remaining elements of the oscillator circuit 26. Such other elements are apparent from FIGS. 2 and 3, which show a preferred embodiment and a more preferred embodiment, respectively.

Figure 2:
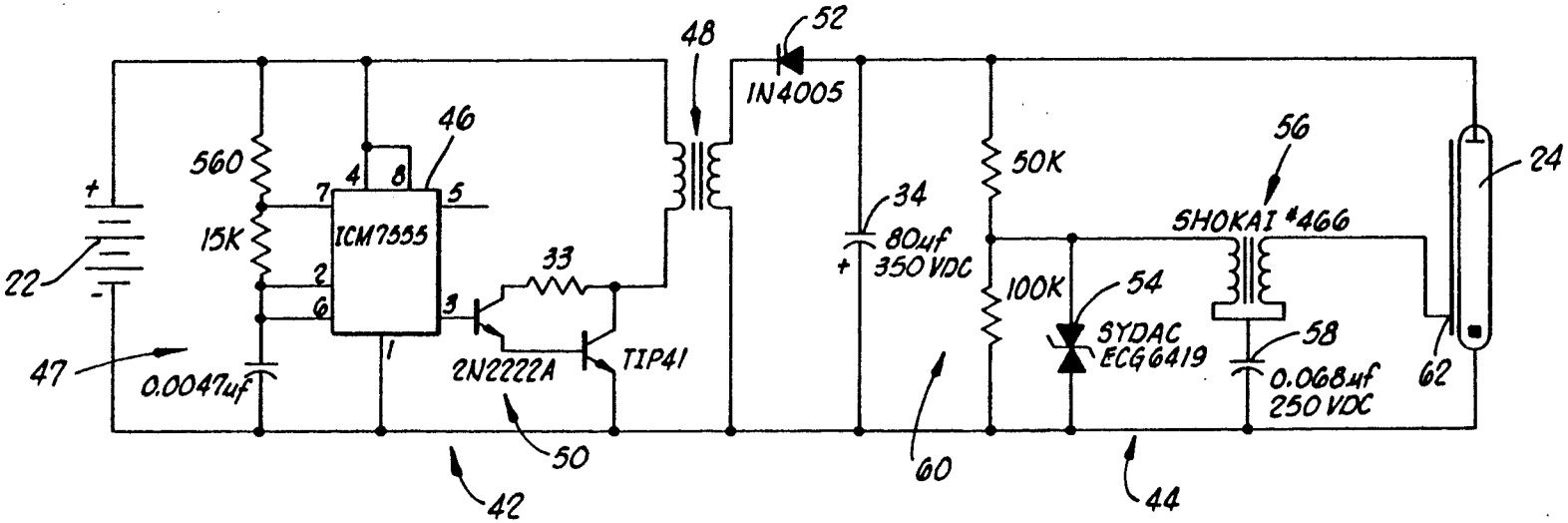
FIG. 2 is a schematic circuit diagram of a preferred embodiment oscillator circuit of the warning light of the present invention.
Figure 5:
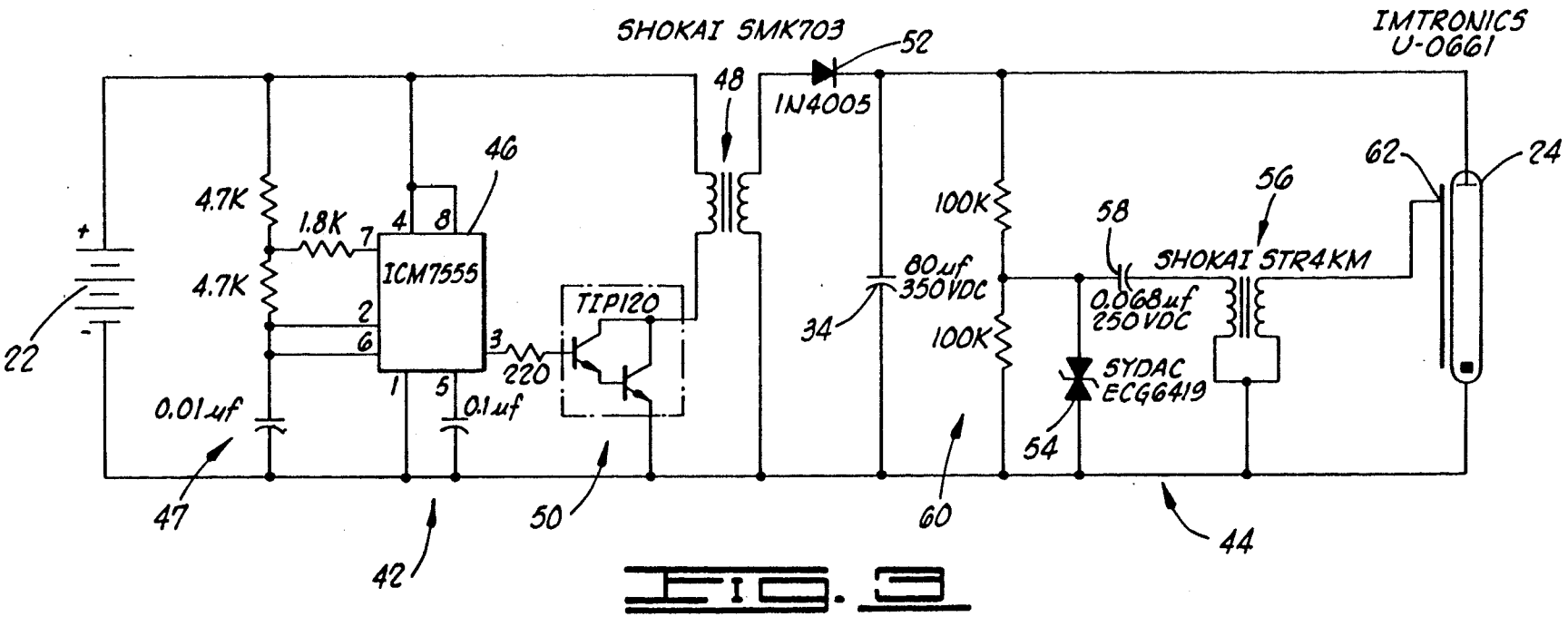

The overall circuit shown in FIG. 2 can be divided into an inverter 42 and a high-voltage trigger 44 for the connected flash tube 24 also depicted in the drawing. The inverter portion 42 provides medium voltage power that ultimately is discharged through the flash tube 24. The trigger portion 44 of the circuit provides the high voltage pulse needed to trigger the flash tube 24 into its conducting state.

The inverter portion 42 of the circuit shown in FIG. 2 includes the batteries 22 which supply the necessary power, an integrated circuit oscillator 46 (with timing resistor-capacitor circuit 47), an oscillation transformer 48 and two Darlington connected transistors 50 (the foregoing connected on the primary side of the oscillation transformer 48 , and a rectifying diode 52 and the flash capacitor 34 (connected on the secondary side of the oscillation transformer 48). The trigger portion 44 of the circuit includes a diac 54, a trigger transformer 56, a trigger capacitor 58, and associated resistors 60.

When power is applied to the circuit by suitably screwing the end cap 10 on the sleeve 4 as previously described, the integrated circuit oscillator 46 begins operating and alternately switches the transistors 50 on and off. As a result, the primary winding of the oscillation transformer 48 experiences a substantial oscillating current that induces a smaller, higher voltage current in the oscillation transformer's secondary winding. The diode 52 at the output of the secondary then rectifies this smaller current. Charge from this current is stored in the flash capacitor 34.

As the inverter portion 42 charges the flash capacitor 34, the trigger capacitor 58 is also being charged (through the associated resistors 60). When the voltage across the flash capacitor 34 reaches approximately 200 volts, the diac 54 breaks over and discharges the trigger capacitor 58 through the primary winding of the trigger transformer 56. This discharge induces a high voltage pulse (about 4 kV) in the secondary winding of the trigger transformer 56, which pulse is applied to a trigger terminal 62 of the flash tube 24. This trigger pulse partially ionizes the gas within the flash tube 24, which permits the flash capacitor 34 to discharge through the flash tube 24 having end electrodes across which the flash capacitor 34 is connected. It is this discharge that causes the characteristic bright flash of visible light.

Once the flash capacitor 34 is discharged, the flash tube 24 reverts to its nonconducting state, and both the flash capacitor 34 and the trigger capacitor 58 once again begin to charge in the manner described before. The flashes of light and the cycle of charging and discharging continue as long as power from the batteries 2 is applied to the circuit.

The circuit of FIG. 3 operates in the same manner as the circuit of FIG. 2, and like elements between the two circuits are indicated by like reference numerals.

Referring again to FIG. an additional feature of the present invention is a bumper member 64 at the end 8 of the sleeve 4. The outer diameter of the bumper member 64 is greater than the maximum lateral dimension of the sleeve 4 so that, in conjunction with the end cap 10 which also has a larger lateral dimension, the sleeve 4 will be protectively held off a supporting surface on which the warning light is laid. This bumper member 64 is preferably formed integrally as part of the cover 28. An externally accessible metallic, electrically conductive terminal 66 can be incorporated in this member 64 and connected to the battery terminal opposite the one connected to the rivet 20 so that both positive and negative terminals of the batteries 22 are externally accessible for easily recharging the batteries 22 without disassembling the warning light.

Figure 4:
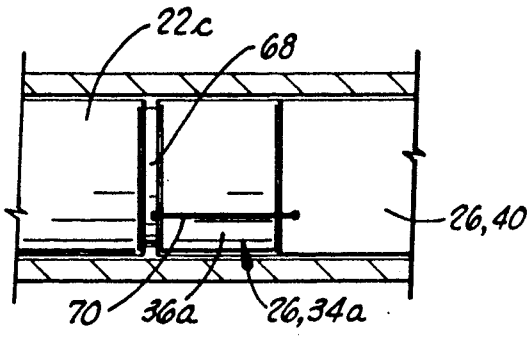
FIG. 4 is a sectional view of part of another preferred embodiment of the present invention.

Referring to FIG. 4, a preferred modification to the FIG. 1 embodiment is shown for implementing another preferred embodiment of the present invention. The modification includes: a flash capacitor 34*a* having an insulated housing 36*a*, and means for electrically connecting the negative terminal of the batteries 22 to the oscillator circuit. Whereas in the FIG. 1 embodiment, this electrical connecting means includes the electrically conductive housing of the flash capacitor 34; in the FIG. 4 embodiment, this connecting means includes an electrically conductive member 68, such as a metallic disk, mounted adjacent the non-conductive insulated housing of the capacitor 34*a* so that it is in between the batteries 22 and the flash capacitor 34*a*. The spring 38 can be in between the negative terminal of the batteries 22 and the member 68, or preferably at the other end of the batteries 22 so that the member 68 abuts and makes direct electrical contact with the batteries 22 and abuts the flash capacitor 34*a* as shown in FIG. 4. A wire 70 connects the member 68 to the portion of the electronic means circuit 26 on the circuit board 40.

The specific size and shape of the warning light can vary, but it is preferably of a size and shape similar to a conventional hazard warning flare. By way of example, the overall length of the preferred embodiments is nominally 12 inches and the diameter of the sleeve 4 is nominally 1½ inches (wall thickness of the aluminum sleeve is nominally ¼ inch). The weight is between one and two pounds (slightly heavier than a conventional flare).

Thus, the present invention is well adapted to carry out the objects and attain the ends and advantages mentioned above as well as those inherent therein. While preferred embodiments of the invention have been described for the purpose of this disclosure, changes in the construction and arrangement of parts can be made by those skilled in the art, which changes are encompassed within the spirit of this invention as defined by the appended claims.

What is claimed is:

1. A portable electric warning light, comprising:

an elongated metallic, electrically conductive housing having two ends and an internal chamber;

a plurality of batteries disposed linearly in electrical series within said internal chamber so that a first terminal of said batteries is at one end of said housing and a second terminal of said batteries is intermediate the two ends of said housing;

closure means for fluid tightly closing said one end of said housing and for activating said warning light, said closure means including:

an end cap connected to said housing at said one end thereof so that said end cap is movable between first and second positions relative to said housing;

seal means for providing a fluid tight seal between said end cap and said housing when said end cap is connected to said housing at said second position; and connecting means for electrically connecting said first terminal of said batteries to said housing when said end cap is connected to said housing at said second position;

a gas discharge flash tube connected to the other end of said housing;

a cover overlying said gas discharge flash tube and connected to said housing at said other end thereof, said cover having a side wall and an end wall both of material which permits passage of visible light therethrough; and electronic means, connected to said gas discharge flash tube and said housing, for causing said gas discharge flash tube to emit flashes of light visible through said cover when said end cap is connected to said housing at said second position so that said connecting means connects said first terminal of said batteries to said housing, wherein said electronic means includes a flash capacitor disposed in said housing between said batteries and said gas discharge flash tube.

2. A portable electric warning light as defined in claim 1, wherein:

said batteries are a source of about 6.48 watt-hours of electrical energy; and said gas discharge flash tube and said electronic means substantially deplete said source of electrical energy in less than about 80 minutes.

3. A portable electric warning light as defined in claim 1, wherein said end cap has a lateral dimension greater than a maximum lateral dimension of said housing and said warning light further comprises a bumper member at said other end of said housing of greater lateral dimension than the maximum lateral dimension of said housing so that said warning light is supported on said end cap and said bumper when said warning light is laid on a support surface, wherein said housing is thereby spaced from the support surface.

4. A portable electric warning light as defined in claim 3, wherein said bumper member is integrally formed on said cover.

5. A portable electric warning light as defined in claim 3, further comprising:

first terminal means for providing on the outside of said end cap a terminal connected through said end cap to said first terminal of said batteries; and second terminal means for providing on the outside of said bumper member a terminal connected through said bumper member to said second terminal of said batteries.

6. A portable electric warning light as defined in claim 1, wherein said flash capacitor has a metallic housing electrically connected to said second terminal of said batteries.

7. A portable electric warning light as defined in claim 1, wherein:

said flash capacitor has an insulated housing; and said electronic means further includes conductor means, mounted on said insulated housing, for making electrical contact with said second terminal of said batteries.

8. A portable electric warning light, comprising:

an electrically conductive sleeve having two threaded ends;

an end cap threadedly connected to one end of said sleeve so that said end cap can be screwed on to an activation position or unscrewed from the activation position;

a sealing ring disposed between said sleeve and said end cap when said end cap is screwed on said sleeve to the activation position;

an electrically conductive disk retained in said end cap so that said disk and said sleeve contact each other when said end cap is screwed on said sleeve to the activation position;

an electrically conductive rivet disposed through said end cap and said disk so that one end of said rivet is on the outside of said end cap and the other end of said rivet is in electrical contact with said disk;

a plurality of batteries disposed in electrical series in said sleeve so that one terminal of said batteries is in electrical contact with said other end of said rivet when said end cap is screwed on said sleeve to the activation position;

a gas discharge flash tube disposed at the other threaded end of said sleeve;

oscillator circuit means for providing oscillating signals to said flash tube, said oscillator circuit means including a first portion disposed in said sleeve adjacent said flash tube, and said oscillator circuit means further including a second portion comprising a flash capacitor, disposed in said sleeve between said batteries and said first portion of said oscillator circuit means, and further comprising means for electrically connecting another terminal of said batteries to said oscillator circuit means; and a cover overlying said flash tube and threadedly connected to said other threaded end of said sleeve.

9. A portable electric warning light as defined in claim 8, wherein:

said batteries are a source of about 6.48 watt-hours of electrical energy; and said gas discharge flash tube and said oscillator circuit means substantially deplete said source of electrical energy in less than about 80 minutes.

10. A portable electric warning light as defined in claim 8, wherein said end cap has a lateral dimension greater than a maximum lateral dimension of said sleeve and said warning light further comprises a bumper member at said other end of said sleeve of greater lateral dimension than the maximum lateral dimension of said sleeve so that said warning light is supported on said end cap and said bumper when said warning light is laid on a support surface, wherein said sleeve is thereby spaced from the support surface.

11. A portable electric warning light as defined in claim 10, wherein said bumper member is integrally formed on said cover.

12. A portable electric warning light as defined in claim 10, further comprising terminal means for providing on the outside of said bumper member a terminal connected through said bumper member to said another terminal of said batteries.

13. A portable electric warning light as defined in claim 8, wherein said means for electrically connecting includes an electrically conductive housing of said flash capacitor.

14. A portable electric warning light as defined in claim 8, wherein said means for electrically connecting includes an electrically conductive member adjacent said flash capacitor.

15. A portable electric warning light, comprising:

a distinctively colored aluminum sleeve having threaded ends;

a plastic end cap threadedly connected to one end of said sleeve;

a sealing ring disposed between said sleeve and said end cap;

an electrically conductive disk retained in said end cap so that said disk and said sleeve contact each other when said end cap is threadedly connected to said sleeve;

an electrically conductive rivet disposed through said end cap and said disk so that one end of said rivet is on the outside of said end cap and the other end of said rivet abuts said disk;

three rechargeable batteries disposed in electrical series in said sleeve so that one terminal of said batteries is in electrical contact with said other end of said rivet when said end cap is threadedly connected to said sleeve, each of said batteries having a nominal 1.2-volt rating;

an electrically conductive spring disposed in said sleeve so that one end of said spring abuts one terminal of said batteries;

a flash capacitor having an electrically conductive member thereon, said flash capacitor disposed in said sleeve so that said electrically conductive member is in electrical contact with the other terminal of said batteries opposite the terminal thereof in electrical contact with said rivet;

a xenon flash tube disposed at the other threaded end of said sleeve;

oscillator circuit means for providing oscillating signals to said xenon flash tube, said oscillator circuit means disposed in said sleeve between said flash capacitor and said xenon flash tube and connected thereto, said flash capacitor incorporated in said oscillator circuit means; and a transparent polycarbonate plastic lens cover overlying said xenon flash tube and threadedly connected to said other threaded end of said sleeve.

16. A portable electric warning light as defined in claim 15, wherein:

said batteries are a source of about 6.48 watt-hours of electrical energy; and said xenon flash tube and said oscillator circuit means substantially deplete said source of electrical energy in less than about 80 minutes.

17. A portable electric warning light as defined in claim 15, wherein said end cap has a lateral dimension greater than a maximum lateral dimension of said sleeve and said warning light further comprises a bumper member at said other end of said sleeve of greater lateral dimension than the maximum lateral dimension of said sleeve so that said warning light is supported on said end cap and said bumper when said warning light is laid on a support surface, wherein said sleeve is thereby spaced from the support surface.

18. A portable electric warning light as defined in claim 17, wherein said bumper member is integrally formed on said cover.

19. A portable electric warning light as defined in claim 17, further comprising terminal means for providing on the outside of said bumper member a terminal connected through said bumper member to said another terminal of said batteries.

20. A portable electric warning light as defined in claim 15, wherein said electrically conductive member includes a metallic housing of said flash capacitor.

21. A portable electric warning light as defined in claim 15, wherein said electrically conductive member includes a metallic member disposed on said flash capacitor so that said metallic member is between said flash capacitor and said batteries.

* * * * *